US005979802A

United States Patent [19]

Hasegawa

[11] Patent Number: 5,979,802

[45] Date of Patent: Nov. 9, 1999

[54] FUEL INJECTION NOZZLE

[75] Inventor: Toshiyuki Hasegawa, Saitama-ken, Japan

[73] Assignee: Zexel Corporation, Tokyo, Japan

[21] Appl. No.: 08/999,445

[22] Filed: Dec. 29, 1997

[30] Foreign Application Priority Data

Jan. 14, 1997 [JP] Japan ..... 9-015954

[51] Int. Cl.[6] ..... F02M 61/18

[52] U.S. Cl. ..... 239/533.12; 239/581.1; 239/585.1

[58] Field of Search ..... 239/533.12, 581.1, 239/562–564, 585.1; 251/304–309

[56] References Cited

U.S. PATENT DOCUMENTS

| | | | |
|---|---|---|---|
| 4,151,958 | 5/1979 | Hofmann | 239/533.3 |
| 4,658,824 | 4/1987 | Scheibe | 239/533.3 |
| 5,645,225 | 7/1997 | Hasagawa et al. | 239/533.12 |

FOREIGN PATENT DOCUMENTS

| | | |
|---|---|---|
| 59-180063 | 10/1984 | Japan . |
| 4-76266 | 3/1992 | Japan . |
| 7-54730 | 2/1995 | Japan . |
| 7-77124 | 3/1995 | Japan . |

*Primary Examiner*—Andres Kashnikow
*Assistant Examiner*—Dinh Q. Nguyen
*Attorney, Agent, or Firm*—Michael J. Striker

[57] ABSTRACT

In a variable nozzle hole area type fuel injection nozzle using a rotary valve a drive arrangement of the rotary valve (7) comprises an actuator (9) mounted to the nozzle holder proper and a drive shaft (8) extending through an axial hole **(43*a*) of the needle valve (4) and having its lower end reaching the vicinity of the lower end of the needle valve (4) and a coupling shaft (10) positioned inside a control hole (45) provided in the lower end of the needle valve (4) and as well as performing a torque transmitting function the coupling shaft (10) has a leak passage (10*f*) and a seat portion (10*c*) so that it can perform a valve function for controlling termination of a pilot injection and separately from the actuator there is provided a driving mechanism (14) for forcibly moving the coupling shaft (10) in the axial direction while the needle valve (4) is open to end the action of the seat portion (10*c*)**.

11 Claims, 7 Drawing Sheets

Fig.3-A
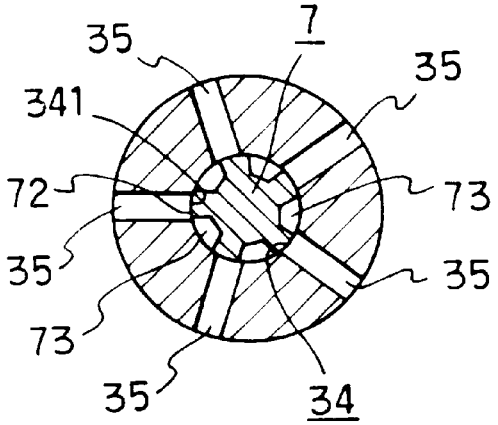
Fig.3-B
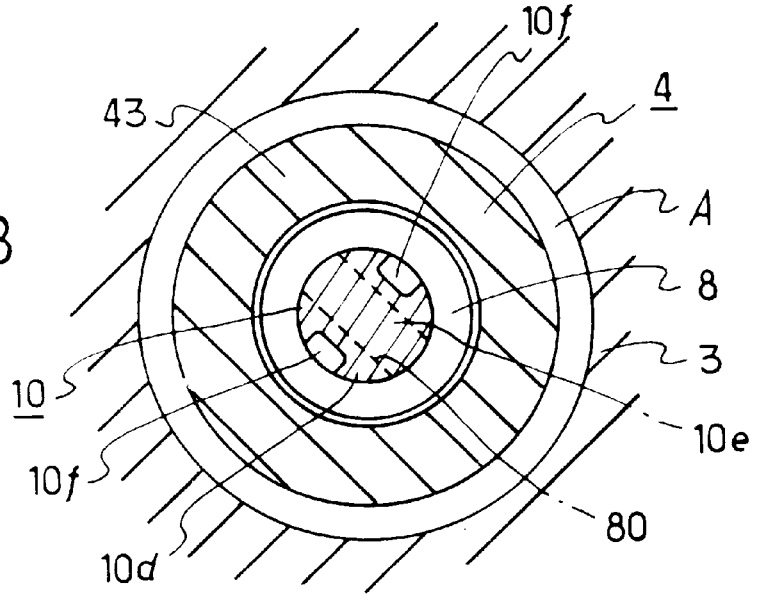
Fig.5
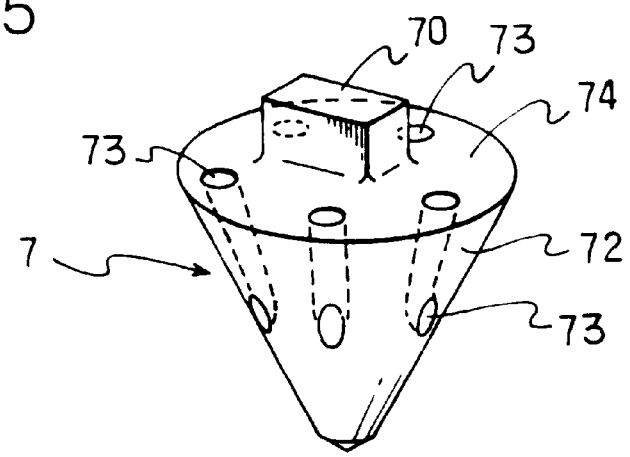

Fig.6-A
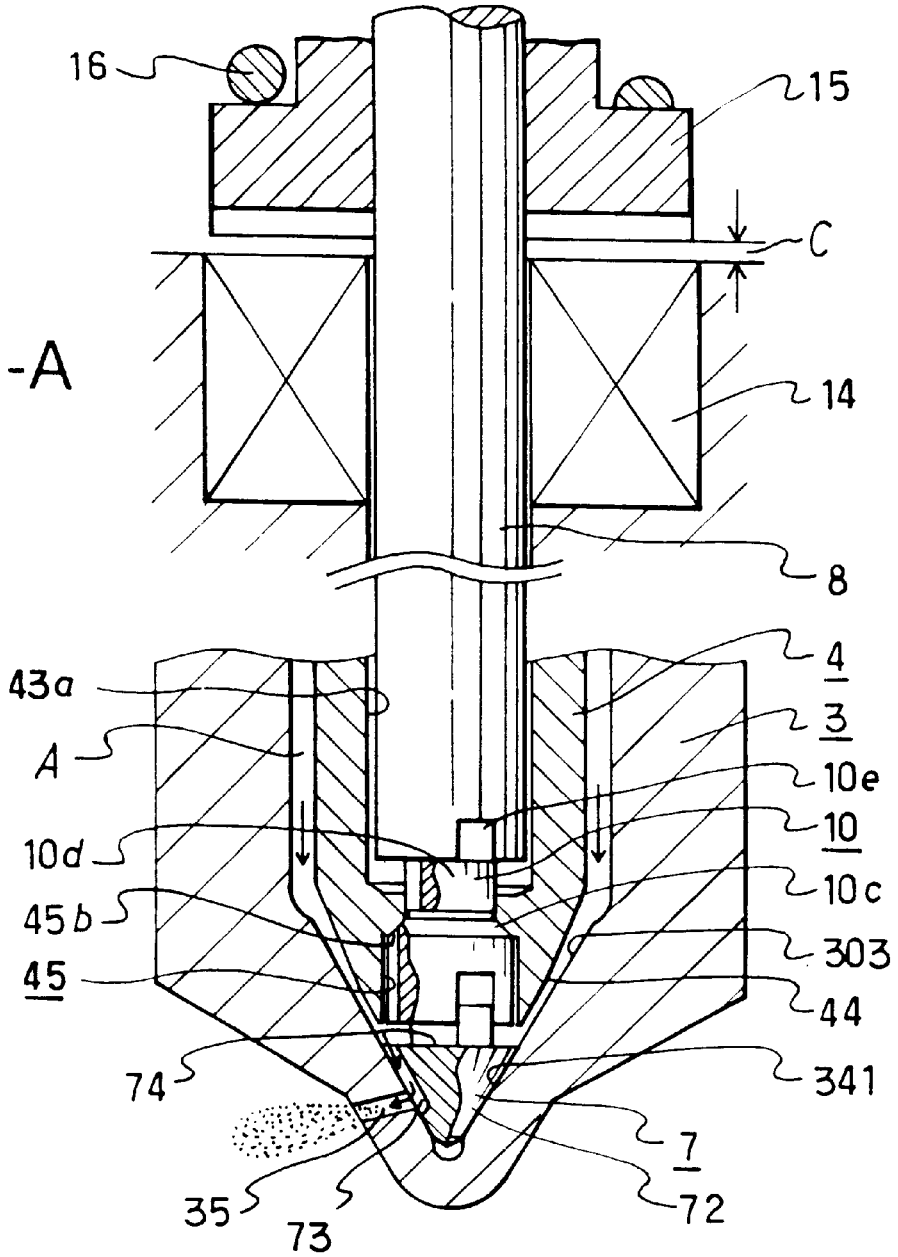
Fig.6-B
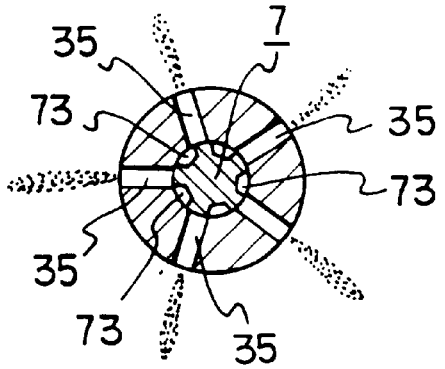

Fig.7-A
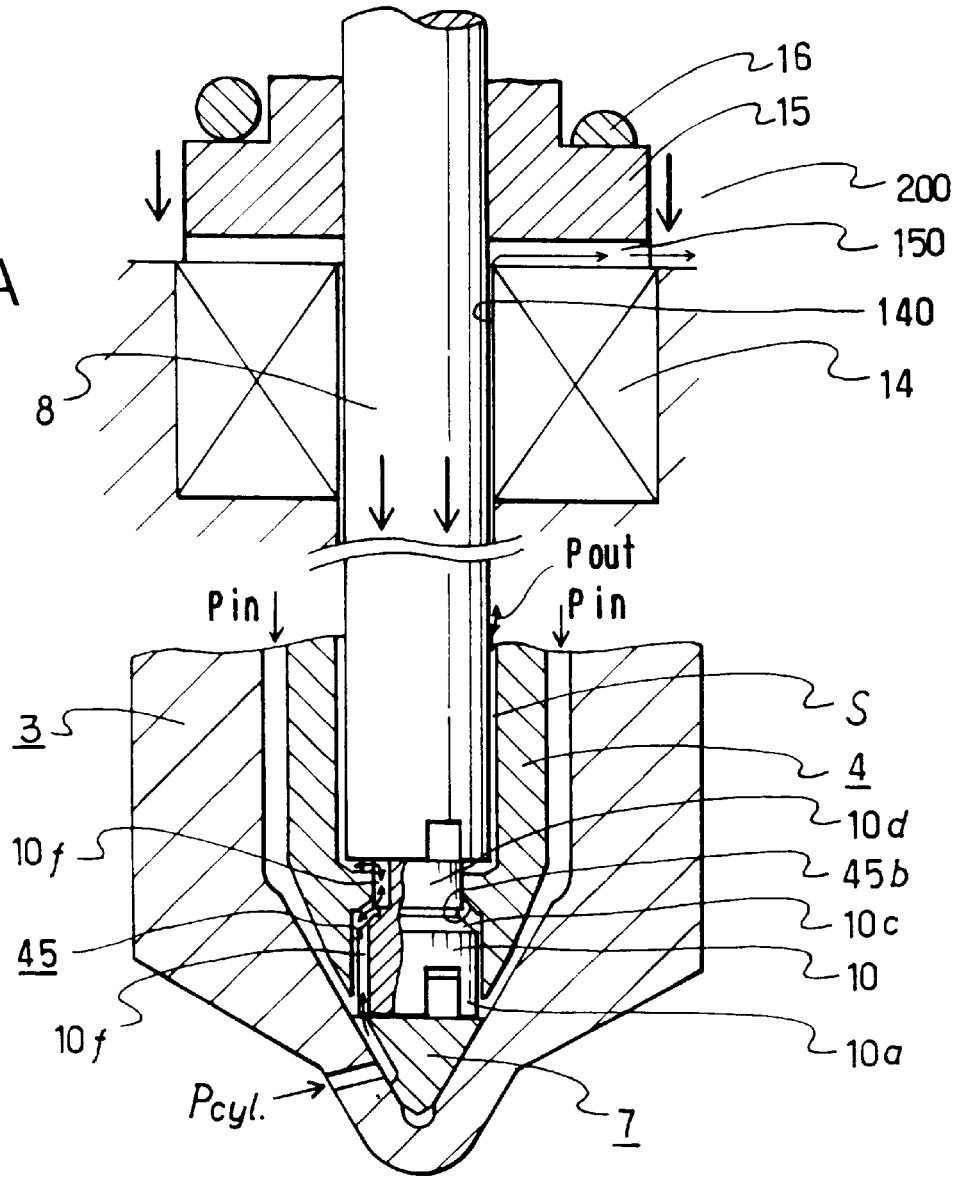
Fig.7-B
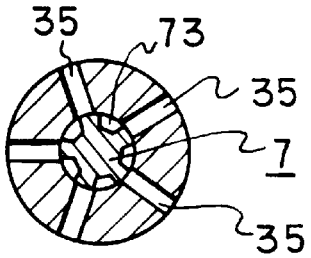

Fig.8-A
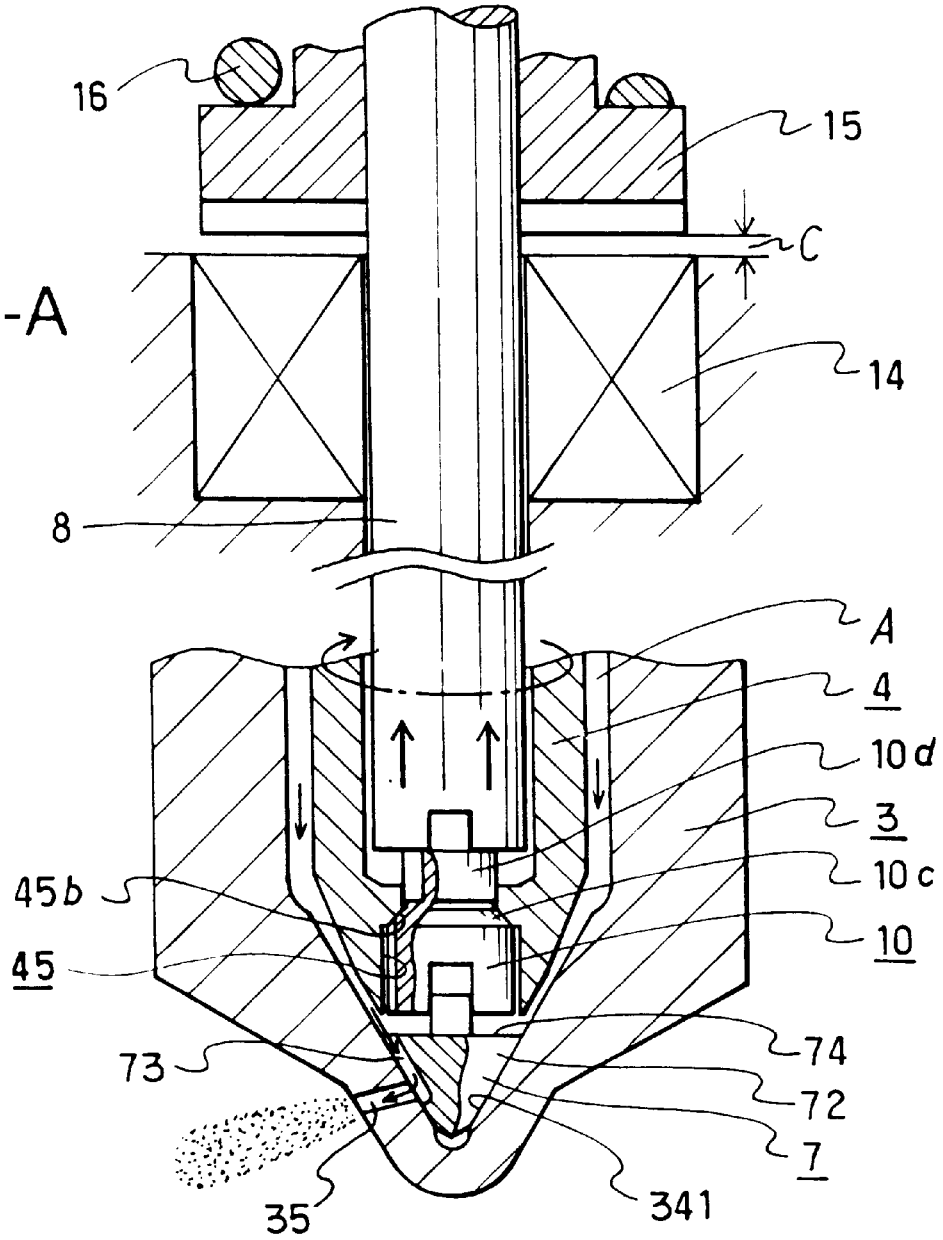
Fig.8-B
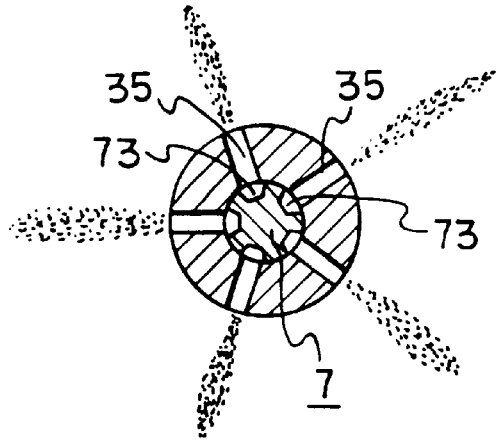

FUEL INJECTION NOZZLE

FIELD OF THE INVENTION

This invention relates to a fuel injection nozzle and particularly to a fuel injection nozzle whose nozzle hole area is variable.

BACKGROUND OF THE INVENTION

As means for supplying fuel in an atomized state to combustion chambers in an internal combustion engine such as a diesel engine, fuel injection nozzles are generally used. Such fuel injection nozzles have had a construction wherein a conical pressure-receiving surface is formed at the tip end of a needle valve axially slidably received inside a nozzle body and the needle valve is opened by a fuel pressure being made to act on this pressure-receiving surface whereupon fuel is injected into a combustion chamber of the engine through a plurality of nozzle holes formed in the tip of the nozzle body.

However, with this construction, the fuel injection pressure, the injected amount and the injection speed are generally determined by a fuel injection pump, and furthermore it is not possible to increase or decrease the total nozzle hole area. Consequently, during low-speed running of the engine the fuel injection pressure decreases and during low-load running of the engine the injection time becomes short and thus it is not possible to maintain a good combustion state, and consequently it has been difficult to promote fuel combustion and achieve improvements in output and fuel consumption and reductions in combustion noise and NOx emissions.

As means to overcome this, in Japanese Unexamined Patent Publication No. S.59-180063, a fuel injection nozzle whose total nozzle hole area is variable was proposed. In this related art, a plurality of nozzle holes (upper nozzle holes) are formed spaced in the circumferential in a wall enclosing the tip part of the nozzle body, and another plurality of nozzle holes (lower nozzle holes) are formed spaced in the circumferential direction in the same wall at a level below the upper nozzle holes in the axial direction of the nozzle. A shaft passes axially slidably through a through hole formed down the center axis of a needle valve received in the nozzle body with the circumferential surface of the tip of this shaft positioned so that it covers the lower nozzle holes, and by this shaft being moved in the axial direction by an actuator the lower nozzle holes can be opened.

However, in this related art, because it is not the degree of opening of each of the nozzle holes that is changed but rather it is merely the number of open nozzle holes that is changed, there have been the problems that it is not possible to carry out fine adjustment based on the running state of the engine and that the spray direction of injections changes with the selection of the nozzle holes.

In Japanese Unexamined Patent Publication No. H.4-76266, another fuel injection nozzle whose total nozzle hole area is variable is proposed. This related art fuel injection nozzle is of a rotary valve type. Specifically, a well is formed in the tip part of a nozzle body and a plurality of nozzle holes (eight) connecting with the well are formed spaced in the circumferential direction in a wall enclosing the well. A rotary shaft passes through a through hole formed axially down the center of the needle valve, a tip portion of this rotary shaft is positioned in the well, and a plurality of channels (four) which connect a fuel pressure chamber inside the well to the nozzle holes when the needle valve opens are provided in the rotary shaft. By rotation of this rotary shaft, the number of open nozzle holes is switched between eight and four, However, in this related art also, it is just the number of open nozzle holes that is varied, and there are the problems that it is not possible to carry out fine adjustment based on the running state of the engine and that the spray direction of injections changes with the selection of the nozzle holes. Also, the wall forming the well forms a straight cylinder parallel with the nozzle axis, and the rotary shaft serving as the rotary valve is also cylindrical. Because of this it has been difficult to fix the position of the rotary shaft constituting the rotary valve during fuel injection. That is, even when the nozzle holes have been adjusted to a required degree of opening by the angle of the rotary shaft being changed the rotary shaft easily slips undesirably in its direction of rotation about its axis when a high fuel injection pressure acts at the nozzle holes. Consequently, it has not been possible to avoid the positional relationship between the nozzle holes and the channels slipping and the nozzle hole area becoming larger or smaller than the set size.

For these reasons, in both of these related art examples there has been the problem that it is difficult to accurately carry out fine control of the total nozzle hole area in accordance with the load and speed of the engine.

Also, to realize optimal fuel combustion of the engine, it is desirable to control the injection rate so as to conduct a pilot injection before a main injection. To this end it is necessary to create a state, between a pilot injection at a low injection rate and a main injection, wherein injection is not carried out, and to do this it is necessary structurally to be able to intentionally allow leakage of fuel to a low pressure side while the needle valve is open. However, in the former of the related art nozzles described above, because the upper nozzle holes are always connected with the combustion chamber, it is not possible to create a non-injection state. And also in the latter of the related art examples described above, because a plurality of nozzle holes are always connected with the combustion chamber, it is not possible to create a non-injection state. Furthermore, because the contact between the outside of the rotary shaft serving as the rotary valve and the inside wall of the through hole of the needle valve forms a seal, for this reason also it is not possible to provide a non-injection state. Therefore, it has been impossible to conduct a pilot injection.

With regard to pilot injections, a control mechanism in a jerk type fuel injection system is proposed in Japanese Unexamined Patent Publication No. H.7-77124. However, in this related art, because the injection amount and the injection period and so on of the pilot injection are determined by the relative positions of a plunger and a leak hole of a fuel injection pump, there has been the problem that the degree of freedom of these parameters is small.

In Japanese Unexamined Patent Publication No. H.7-54370, a solenoid-driven fuel injection nozzle is proposed, but in this related art there is the problem that it is not possible to apply an optimal nozzle hole area to a pilot injection.

SUMMARY OF THE INVENTION

It is therefore an object of the present invention to provide a fuel injection nozzle of this type with which it is possible not only to control the nozzle hole area and the injection period so that the injection pressure, the injection period and the injected amount are matched to the load and the speed of the engine but it is also possible to conduct a pilot injection and a variable nozzle hole area main injection easily and surely.

To achieve this object and other objects the invention provides a fuel injection nozzle of a type having a nozzle holder proper and a nozzle body and in a tip part of the nozzle body a well for guiding pressurized fuel and on the entrance side of this well a needle valve opened and closed by a predetermined fuel pressure, a plurality of nozzle holes through which pressurized fuel is injected being provided spaced in the circumferential direction in a wall enclosing the well and a rotary valve having a plurality of fuel passage s corresponding to the nozzle holes being disposed in the well and rotated to adjust the open area of the nozzle holes, characterized in that it has the following features.

A drive arrangement of the rotary valve comprises an actuator mounted to the nozzle holder proper and a drive shaft extending through an axial hole of the needle valve and having its lower end reaching the vicinity of the lower end of the needle valve and a coupling shaft positioned inside a control hole provided in the lower end of the needle valve, the coupling shaft being connected to the drive shaft and to the rotary valve movably in the axial direction relative to each.

A low pressure passage for guiding leak fuel in the axial direction is formed between the drive shaft and the axial hole and between the coupling shaft and the control hole a leak passage for connecting the low pressure passage with the inside of the well is provided and the coupling shaft and the control hole respectively comprise seat portions and these seat portions make contact with each other and prevent opening of the leak passage when the coupling shaft is lifted by a pressure of pressurized fuel along with opening of the needle valve. On the nozzle holder proper side there are provided driving means for forcibly moving the coupling shaft in the axial direction while the needle valve is open to move the seat portion and apart to open the leak passage.

If this kind of construction is adopted, in addition to the basic effect that it is possible to achieve any nozzle hole area steplessly by rotation of the rotary valve, it is also possible to realize an optimal pilot injection. That is, if the rotary valve is set to an angle optimal for an initial injection while the needle valve is closed and the fuel passages are connected with the nozzle holes in the well enclosing wall by a required opening area, when the needle valve opens a pilot injection is carried out.

Then, with the needle valve still open, if the driving means is operated to apply an axial direction moving force to the coupling shaft, the coupling shaft descends and the seat portions of the needle valve and the coupling shaft move apart and the leak passage is thereby opened and pressurized fuel at an injection pressure flowing into the well is allowed to escape though the leak passage to the low pressure passage and consequently it is possible to create a non-injection state wherein fuel injection through the nozzle holes is not carried out and the pilot injection is thereby terminated. Thus, by suitably selecting the timing at which the coupling shaft driving means is driven, it is possible to conduct a pilot injection freely and easily.

When a main injection is to be carried out, the driving of the driving means is stopped. When this is done, because the upward force due to fuel pressure of the coupling shaft or the force of the urging means causes the seat portion of the coupling shaft and the seat portion of the needle valve to make contact with each other the injection pressure is restored and a main injection can be conducted and it is possible to carry out fuel spraying with characteristics optimal for engine combustion.

The leak passage can be easily realized by providing vertical channels in the outer surfaces of the coupling shaft.

Preferably the driving means has a solenoid and an armature fixed to the drive shaft, and the coupling shaft is moved in the axial direction by the drive shaft being moved in the axial direction by the armature being attracted to the solenoid. An elastic member urging the armature is preferably used as the urging means.

Also, preferably, the well enclosing wall having the plurality of nozzle holes has a conical surface and the rotary valve has at its upper end a pressure-receiving surface for receiving pressure of pressurized fuel and at its circumferential periphery a conical seat surface corresponding to the conical surface of the well enclosing wall.

When this construction is employed, when the needle valve opens and a fuel injection pressure acts on the pressure-receiving surface, a frictional force overcoming a torque due to fuel pressure tending to rotate the rotary valve arises between the rotary valve and the well enclosing wall, and the rotary valve is surely held in position by the fuel injection pressure only. Also, because a tight surface seal is formed by the contact between the conical surfaces, pressurized fuel does not flow from the openings of the fuel passages in the circumferential direction. Therefore, it is possible to carry out a pilot injection and a main injection with correctly adjusted injection amounts.

Other features and advantages of the invention will be made apparent by the following detailed description of a presently preferred embodiment thereof; however, the invention is not limited to the construction shown in the preferred embodiment and it will be clear to those skilled in the art that various changes and modifications are possible within the spirit and scope of the invention.

BRIEF DESCRIPTION OF THE DRAWINGS

FIG. 3-A is a sectional view on the line X—X in FIG. 2;

FIG. 3-B is a sectional view on the line Y—Y in FIG. 2;

FIG. 5 is a perspective view showing another example of a rotary valve in the invention;

FIG. 6-A is a sectional view showing the state of a fuel injection nozzle according to the invention at the time of a pilot injection;

FIG. 6-B is a cross-sectional view corresponding to FIG. 6-A;

FIG. 7-A is a sectional view showing the state of the same fuel injection nozzle at the end of a pilot injection;

FIG. 7-B is a cross-sectional view corresponding to FIG. 7-A;

FIG. 8-A is a sectional view showing the state of the fuel injection nozzle at the time of a main injection;

FIG. 8-B is a cross-sectional view corresponding to FIG. 8-A; and

DESCRIPTION OF THE PREFERRED EMBODIMENTS

Preferred embodiments of the invention will now be described with reference to the accompanying drawings.

Figure 1:
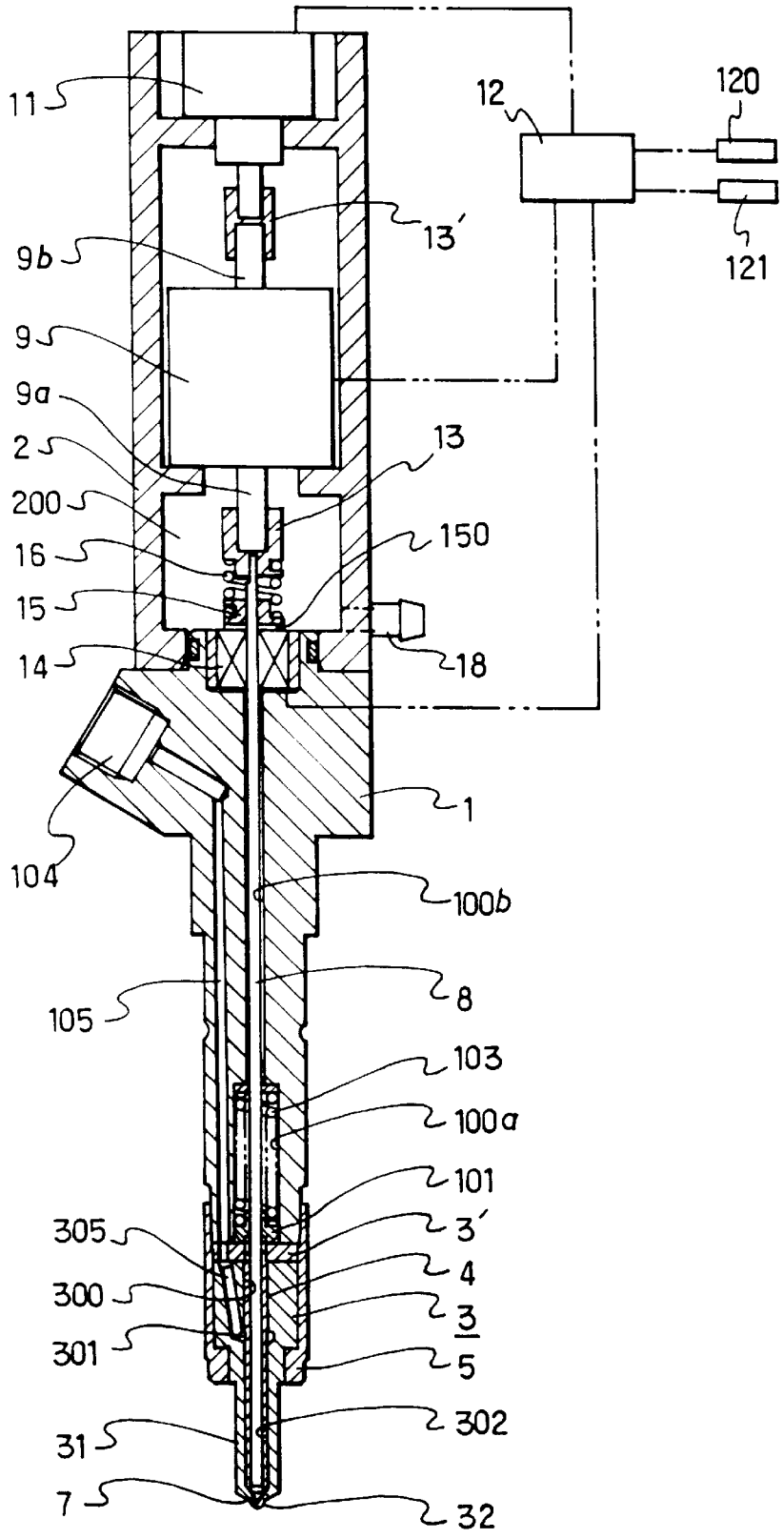
FIG. 1 is a longitudinal sectional view showing a preferred embodiment of a fuel injection nozzle according to the invention.

FIG. 1 through FIG. 4 show a preferred embodiment of a fuel injection nozzle according to the invention. In FIG. 1, the reference numeral 1 denotes a nozzle holder proper including a driving head 2 oiltightly fitted to the upper end of the nozzle holder proper 1.

A nozzle body 3 is connected to the lower end of the nozzle holder proper 1 with a spacer 3' therebetween and joined to the nozzle holder proper 1 by a retaining nut 5. A needle valve (nozzle needle) 4 is inserted into the nozzle body 3.

In the center of the nozzle holder proper 1 are formed a first hole 100*a* which is for forming a spring chamber and extends from the lower end of the nozzle holder proper 1 and an axial hole 100*b* which is a second hole of a smaller diameter than the first hole 100*a* and extends from the upper end of the first hole 100*a* to the upper end of the nozzle holder proper 1. The first hole 100*a* has a pushing member 101 slidably disposed inside it. A nozzle spring 103 is disposed between the pushing member 101 and the upper end of the first hole 100*a*.

The nozzle body 3 has in its length-direction middle a step which fits in the bottom of the inside of the retaining nut 5 and has tubular part 31 extending downward from this step through the retaining nut 5, and the tip of the tubular part 31 is closed by a tip part (enclosing wall) 32 in which are formed nozzle holes.

In the center of the nozzle body 3, from the upper end toward the lower end thereof, are formed a guide hole 300 concentric with the first hole 100*a* in the nozzle holder proper 1 and below that a fuel reservoir 301 of a larger diameter than the guide hole 300, and below the fuel reservoir 301 is formed a fuel feed hole 302.

Figure 2:
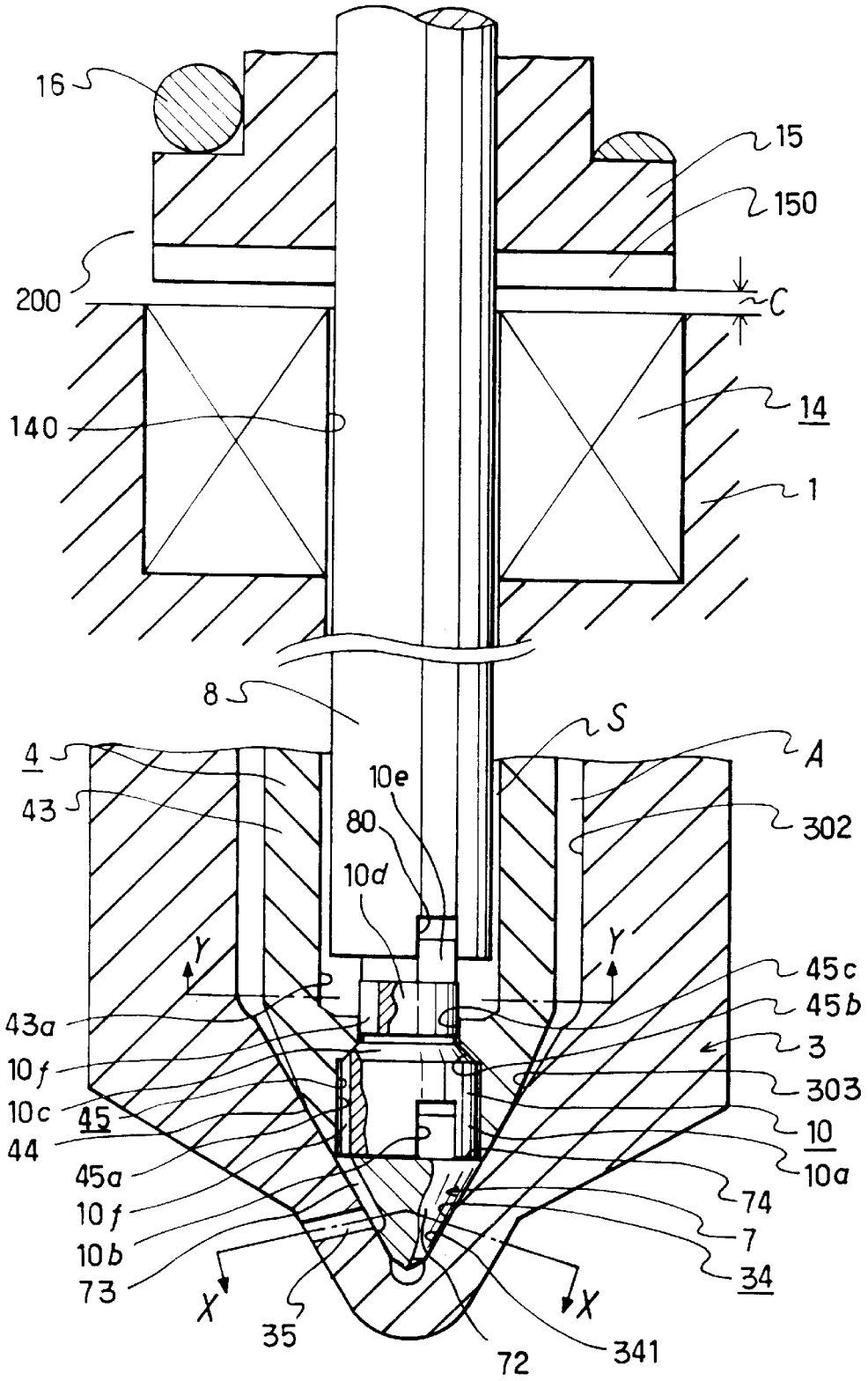
FIG. 2 is an enlarged partial view of FIG. 1 showing a state before fuel injection.

A conical seat surface 303 is formed at the lower end of this feed hole 302, as shown in FIG. 2, and continuing from this conical seat surface 303 a bottomed well 34 into which pressurized fuel is fed is formed by the tip part 32.

A pressurized fuel supply opening 104 is provided on one side of the nozzle holder proper 1, and this pressurized fuel supply opening 104 is connected to a jerk type fuel injection device or an accumulator type fuel injection device (not shown). The pressurized fuel supply opening 104 is connected with the fuel reservoir 301 by way of passage holes 105, 305 formed in the nozzle holder proper 1 and the nozzle body 3 and feeds pressurized fuel from the above-mentioned fuel injection device into the fuel reservoir 301.

The needle valve 4, like known needle valves, has at its upper end a mating part which mates with the pushing member 101, and has at its middle periphery a guide part which makes sliding contact with the guide hole 300 and a pressure-receiving part for receiving the fuel pressure inside the fuel reservoir 301. Below this pressure-receiving part 42 it has a shaft part 43 for forming an annular fuel passage A between itself and the feed hole 302, as shown in FIG. 2. Also, a conical seat surface 44 for coming in and out of contact with the above-mentioned seat surface 303 is formed on the lower end of this shaft part 43. Also, an axial hole 43*a* through which a drive shaft which will be further discussed later passes is formed in the center of the shaft part 43.

The inner side of the enclosing wall bounding the well 34 has a conical surface 341 smoothly continuous with the seat surface 303, as shown in FIG. 2, and at the lower end of the conical surface 341 there is a hemispherical end wall surface.

As shown in FIG. 3-A, a plurality of nozzle holes 35 having their inner ends connecting with the inside of the well 34 are formed with a uniform circumferential spacing in the enclosing wall. In this preferred embodiment there are five nozzle holes 35 extending radially with a circumferential spacing of 72°. The axis of each nozzle hole 35 may be perpendicular to the nozzle axis, but in this preferred embodiment has a predetermined angle of inclination to the nozzle axis. Also, although the shape of each nozzle hole 35 in a cross-section perpendicular to its axis in this preferred embodiment is circular, it may alternatively be polygonal, and if this is done it is possible to increase the amount of change in the nozzle hole area per unit angle of turn of a rotary valve discussed next.

A rotary valve 7 is rotatably disposed in the well 34. An arrangement for driving this rotary valve 7 includes a coupling shaft 10 disposed immediately above the rotary valve 7, a drive shaft 8 extending upward through the center of the needle valve 4 and the nozzle holder proper 1, and an actuator 9 mounted in the driving head 2, and by this actuator 9 being driven the rotary valve 7 can be rotated about the nozzle axis.

Describing this drive arrangement in more detail, as shown in FIG. 2, a control hole 45 opening at the lower end of the shaft part 43 of the needle valve 4 is formed in the lower end of this shaft part 43. This control hole 45 is made up of a first hole 45*a* opening at the lower end of the shaft part 43, a second hole 45*c* of a smaller diameter than the first hole 45*a*, and a conical seat portion 45*b* connecting the first hole 45*a* and the second hole 45*c*. The diameter of the first hole 45*a* is preferably substantially the same as the diameter of a pressure-receiving surface of the rotary valve 7, which will be further discussed later. The second hole 45*c* connects with an axial hole 43*a* formed in the shaft part 43. The axial hole 43*a* is of a larger diameter than the first hole 45*a* and in the axial direction reaches the upper end of the needle valve 4.

In this invention, as well as being means for transmitting turning torque to the rotary valve 7 while allowing axial direction play of the rotary valve 7 needed for lifting of the needle valve 4, the coupling shaft 10 at the same time also functions as a valve for controlling the end of a pilot injection.

Figure 4:
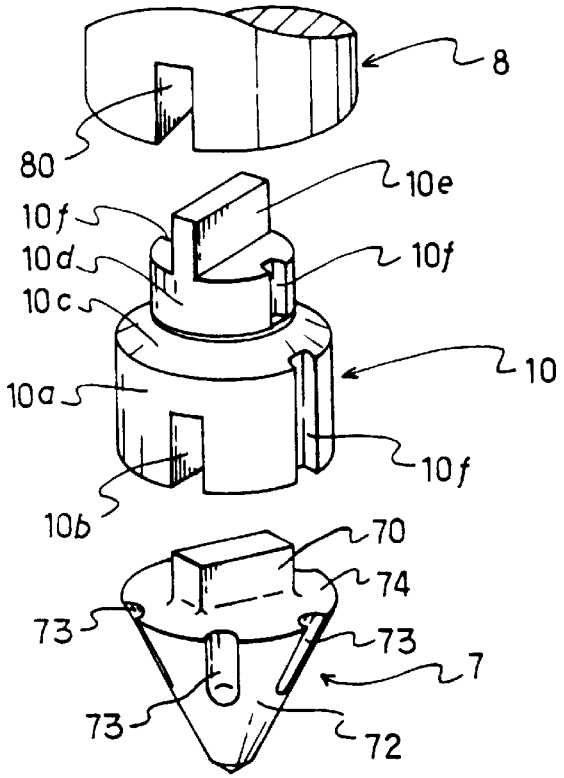
FIG. 4 is an exploded perspective view showing a rotary valve and a coupling shaft and a drive shaft in the invention.

Specifically, the coupling shaft 10 has a cylindrical portion 10*a* of a diameter such that it fits loosely in the first hole 45*a*, and a groove 10*b* for connecting the coupling shaft 10 to the rotary valve 7 slidably in the axial direction with respect thereto is formed in the lower end of this cylindrical portion 10*a*. At the upper end of the cylindrical portion 10*a*, as shown in FIG. 2 and FIG. 4, the coupling shaft 10 has a conical seat portion 10*c* which has the same cone angle as that of the seat portion 45*b* and can make surface contact with the conical seat portion 45*b*. These seat portions 45*b* and 10*c* perform the role of closing a leak passage which will be further discussed later. A short shaft portion 10*d* fitting into the second hole 45*c* extends from the upper end of this seat portion 10*c*. A projecting piece 10*e* is formed on the upper end of this short shaft portion 10*d* and extends across the short shaft portion 10*d*. This projecting piece 10*e* fits axially movably with respect to the drive shaft 8 in a groove 80 provided in the lower end of the drive shaft 8 and transmits rotating torque from the drive shaft 8 to the coupling shaft 10. The projecting piece 10*e* and the groove 80 are set to dimensions such that whatever the position of the drive shaft 8 the projecting piece 10*e* remains engaged with the groove 80.

This coupling shaft 10 also has one or more leak passages 10*f* for effecting pilot injection termination. The leak passages 10*f* preferably consist of one or more channels provided vertically at least in the outer circumferential surface of the short shaft portion 10*d*. To make leakage more rapid, leak passages 10*f* may also be provided in the outer circumferential surface of the cylindrical portion 10*a*. These leak passages 10*f* also consist of one or more vertical channels, and the upper ends of the vertical channels reach the conical seat portion 10*c*, as shown in FIG. 4.

As shown in FIG. 2, the drive shaft 8 has a diameter such that a low pressure passage s of a suitable gap dimension is formed between the outside of the drive shaft 8 and the axial hole 43*a* of the needle valve 4, and the lower end of the drive shaft 8 reaches the lower end vicinity of the axial hole 43*a* of the needle valve 4. As described above, the drive shaft 8 is connected to the coupling shaft 10 by the groove 80 at its lower end. The drive shaft 8 extends upward through the axial hole 43*a* in the needle valve 4 and as shown in FIG. 1 passes through the pushing member 101 and also through the first hole 100*a* and then the axial hole 100*b* of the nozzle holder proper 1. There is a gap between the axial hole 100*b* and the drive shaft 8 through which fuel can leak. The actuator 9 is mounted in a space 200 inside the driving head 2, and the drive shaft 8 is connected movably slightly in the axial direction with respect thereto (but integral therewith in the rotation direction) to a shaft coupling 13 connected to an output shaft 9*a* of the actuator 9. The actuator 9 may be any electrically controlled actuator, and for example a stepping motor or a servo motor is used.

Further, the invention has driving means 14 for forcibly moving the drive shaft 8 in the axial direction and thereby moving the seat portion 10*c* of the coupling shaft 10 away from the conical seat portion 45*b* of the needle valve 4 when the needle valve 4 has been lifted (when the needle valve 4 is open). Also, preferably, the fuel injection nozzle has urging means 16 for when the driving means 14 stops operating moving the drive shaft 8 axially in the opposite direction and thereby seating the seat portion 10*c* of the coupling shaft 10 on the conical seat portion 45*b* of the needle valve.

The driving means 14 and the urging means 16 are positioned in the upper end vicinity of the nozzle holder proper 1. Specifically, for the driving means 14, electrically operated and highly responsive means are used. Although it may for example be a piezoelectric device, from the point of view of cost in practice a cheaper device such as a solenoid is used. In this preferred embodiment an example wherein a solenoid is used is shown. This solenoid, as shown in FIG. 1 and FIG. 2, is mounted in the center of the upper end of the nozzle holder proper 1 so as to surround the drive shaft 8. An armature 15 serving as an output element of the driving means is fixed to the part of the drive shaft immediately above the attracting side (the upper side) of the solenoid, and the drive shaft 8 and the armature 15 move integrally.

As the urging means 16, an elastic member is normally employed. In this example a tension spring is used, and this is interposed between the armature 15 and the shaft coupling 13 and normally urges the armature 15 (and hence the drive shaft 8) upward (away from the solenoid). The urging means 16 may alternatively be interposed between the armature 15 and the attracting side of the solenoid and be of a type such that it normally urges the armature 15 upward. In this case a spring consisting of a non-magnetic body might be preferably used.

When the drive shaft 8 moves downward, the leak passages 10*f* of the coupling shaft 10 connect the low pressure passage s of the needle valve 4 with the well 34, and pressurized fuel flows axially upward through the low pressure passages and is discharged to outside through a suitable part of the nozzle holder proper 1 including the driving head 2.

This discharge route may be any suitable route, but in the preferred embodiment shown in the drawings the gap between the first hole 100*a* and the axial hole 100*b* of the nozzle holder proper 1 and the drive shaft 8 and a gap between a hole 140 in the driving means 14 through which the drive shaft 8 passes and the drive shaft 8 are utilized as a leak passage. A passage 150 connecting with the space 200 of the driving head 2 is provided in the underside of the armature 15, and a discharge pipe 18 connecting with the space 200 is connected to one side of the driving head 2. The passage 150 may for example be a radial groove. However, as the discharge route, instead of this, for example a dedicated leak passage having one end connecting with the first hole 100*a* and the other end opening at a side of the nozzle holder proper 1 may be formed in the nozzle holder proper 1.

The rotary valve 7 in this preferred embodiment has at its upper end a flat pressure-receiving surface 74 on which the pressure (injection pressure) of pressurized fuel acts when the needle valve 4 is open. A projecting piece 70 is formed integrally in the approximate middle of this pressure-receiving surface 74, and this projecting piece 70 is fitted in the groove 10*b* of the coupling shaft 10, slidably in the axial direction with respect thereto. The projecting piece 70 and the groove 10*b* are set to dimensions such that they remain engaged whatever the axial direction position of the coupling shaft 10.

The rotary valve 7 has extending downward from the periphery of the pressure-receiving surface 74 a conical seat surface 72 tapering at an angle matching that of the conical surface 341 of the well enclosing wall, and when the pressure of pressurized fuel acts on the pressure-receiving surface 74 the conical surface 72 and the conical surface 341 make firm contact and a frictional seat surface is formed.

The radius of the pressure-receiving surface 74 of the rotary valve 7, the lower end radius of the conical seat surface 72 and the inclination angle of the conical seat surface 72 and the conical surface 341 with respect to the nozzle axis are so selected that the rotating torque $T_1$ (Nm) tending to rotate the rotary valve 7 and the position-holding torque $T_2$ (Nm) provided by friction between the conical seat surface 72 and the conical surface 341 are in the relationship $T_1<T_2$. The inclination angle of the conical surface 341 of the well 34 and the conical seat surface 72 of the rotary valve 7 is generally selected from the range of 50 to 70°, and therefore all that is necessary is for the radius of the pressure-receiving surface 74 and the lower end radius of the conical seat surface 72 to be set with this as a reference, and by doing this it is possible to fix the position of the rotary valve 7 with the fuel injection pressure alone.

A plurality of fuel passages 73 are provided spaced in the circumferential direction in this rotary valve 7. The fuel passages 73 are spaced at the same spacing as the nozzle holes 35 and each have one end opening at the pressure-receiving surface 74 and the other end connectable with the nozzle holes 35 at the conical surface 341.

In the example shown in FIG. 2 through FIG. 4, the fuel passages 73 are five channels, the same number as there are nozzle holes 35, and each of these channels has a dimension in a section perpendicular to its axis at least equal to the diameter of the nozzle holes 35, as shown in FIG. 3-A, and terminates at a level approximately immediately below the nozzle holes 35, as shown in FIG. 2. In this example the channels have their channel bottoms substantially parallel with the angle of inclination of the conical seat surface 72 of the rotary valve 7, but they may alternatively be parallel with the nozzle axis.

FIG. 5 shows another example of the rotary valve 7. In this example, the fuel passages 73 are not channels but holes, each having one end open at the pressure-receiving surface 74 and the other end open at the conical surface 72.

These fuel passages 73 may each be a separate hole, but they do not have to be and for example holes opening at the conical surface 72 may be connected together by a common hole at their inner ends and holes then formed from the pressure-receiving surface 74 to the common hole.

When the kind of rotary valve shape described above is adopted, the pressure of pressurized fuel acting on the pressure-receiving surface 74 causes the conical seat surface 72 and the conical surface 341 of the well enclosing wall to make frictional surface contact and the rotary valve 7 is thereby held in position. On the basis of this, if the relationship between the holding torque $T_2$ on the rotary valve and the torque $T_1$ tending to rotate the rotary valve, i.e. $T_2-T_1$, is made a small difference $\Delta T$, by applying a small torque from outside just sufficient to overcome the difference $\Delta T$ between $T_2$ and $T_1$, it is possible to rotate the rotary valve 7 and thereby change the open area of the nozzle holes 35 during fuel injection.

In FIG. 1, the reference numeral 11 denotes an angle detecting mechanism for controlling the amount by which the actuator 9 is driven so that a required nozzle hole area can be obtained by means of the rotary valve 7. This control includes carrying out position correction when there is an error between the angle of the rotary valve 7 and a set angle. This angle detecting mechanism 11 can be any suitable mechanism such as a potentiometer, an encoder or a collimator. In this preferred embodiment a potentiometer is used; an additional output shaft 9*b* is provided on the opposite side of the actuator 9 from the main output shaft of the actuator 9, and the potentiometer is connected to this by way of a shaft coupling 13'.

The angle detecting mechanism 11 detects the angle of the output shaft 9*b* and hence that of the drive shaft 8 and the rotary valve 7, and sends a feedback signal to a controller 12 comprising a CPU.

A speed-detecting sensor 120 (or an angle detecting sensor) of the engine or the fuel injection device and a load-detecting sensor 121 are connected to inputs of the controller 12. A signal from the speed-detecting sensor 120 is constantly inputted into the controller 12, and a driving signal is outputted to the actuator 9. A signal from the load-detecting sensor 121 is simultaneously inputted into the controller 12, and driving control of the actuator 9 is carried out according to a predetermined map of load and speed data. Rotation of the rotary valve 7 is preferably carried out during the intake stroke or the exhaust stroke of the respective cylinder of the engine.

In this invention, the whole of the well enclosing wall does not necessarily have to have a conical surface. That is, a straight cylindrical surface parallel with the axis of the nozzle may be formed from the end of the seat surface 303 to the middle and the tapering conical surface 341 may be formed from the end of this straight cylindrical surface. In this case, the rotary valve 7 also has a straight cylindrical surface parallel with the nozzle axis from the pressure-receiving surface 74 to a middle part and the conical surface 72 is formed from the end of this. This is also included in the invention.

Also, although in this preferred embodiment there are five nozzle holes 35 and five fuel passages 73, of course the invention is not limited to this and there may alternatively be three, four or six or more of each.

Also, the drive shaft arrangement is not limited to that described in this preferred embodiment, and for example a coupling pin may be interposed between the drive shaft 8 and the coupling shaft 10.

In some cases the rotary valve shape may be cylindrical, in which case the well enclosing wall is also made correspondingly cylindrical.

Operation

The operation of this preferred embodiment of the invention will now be described.

Pressurized fuel is fed from a fuel injection device (not shown) through a pipe to the pressurized fuel supply opening 104 and is pushed through the passage holes 105, 305 into the fuel reservoir 301 and from there passes down through the annular fuel passage. This pressurized fuel simultaneously acts on the pressure-receiving surface of the needle valve 4 positioned in the fuel reservoir 301, and when the fuel pressure reaches a pressure such that it overcomes the set force of the nozzle spring 103 the needle valve 4 is lifted and the seat surface 44 at the lower end of the needle valve moves away from the seat surface 303 of the nozzle body 3 and the needle valve 4 opens. If the fuel pressure falls, the needle valve 4 is pushed down and closed by the urging force of the spring 103.

Information signals of the speed (or angle) of the engine or the fuel injection device and the load of the engine from the speed-detecting sensor 120 and the load-detecting sensor 121 are inputted into the controller 12, and an angle signal from the angle detecting mechanism 11 is also inputted into the controller 12, and in the controller 12 angles corresponding to nozzle hole areas of an initial injection and a main injection and an amount by which the actuator is to be driven (for example a driving pulse count) are calculated. Then, driving of the actuator 9 is controlled with the output of the angle detecting mechanism 11 being constantly compared with the calculated target angle of the rotary valve 7.

FIG. 2, FIG. 3-A and FIG. 3-B show a state before injection. At this time the needle valve 4 has not been lifted and is closed, and because no fuel pressure is acting on the bottom face of the cylindrical portion 10*a* of the coupling shaft 10 the coupling shaft 10 is not pushed up and is descended so that the bottom face of the cylindrical portion 10*a* is in contact with the pressure-receiving surface 74 of the rotary valve 7. At this time, because the solenoid serving as the driving means 14 is not operating (is Off), the armature 15 is moved away from attracting side of the solenoid by the urging means 16 and as shown in FIG. 2 a gap c of a predetermined size is provided between the underside of the armature 15 and the attracting side of the solenoid. Thus, the drive shaft 8 fixed to the urging means 16 is being held in a predetermined position in the axial direction.

In an initial period before a pilot injection, the rotary valve 7 is set to an angular position such that the nozzle hole area is one optimal for an initial injection. If the present angle of the rotary valve 7 is an angle optimal for an initial injection the rotary valve 7 is left as it is, and if not the actuator 9 is driven by a driving signal from the controller 12. The driving force of the actuator 9 is transmitted to the drive shaft 8, and the rotating torque of the drive shaft 8 is transmitted to the rotary valve 7 through the coupling shaft 10. As a result the rotary valve 7 is rotated through a required angle so that the fuel passages 73 and the nozzle holes 35 overlap over a nozzle hole area optimal for an initial injection, that is, so that the fuel passages 73 connect marginally with the nozzle holes 35 as shown in FIG. 3-A, and held in this position.

At the time of this rotation, because no axial direction load is acting on the rotary valve 7, the conical seat surface 72 is not in strong contact with the conical surface 341 of the well enclosing wall and therefore the rotary valve 7 can be rotated to the required angle easily and smoothly.

If from this state the fuel pressure rises and the needle valve 4 is lifted open, high-pressure fuel enters the well 34 and acts on the lower end surface of the cylindrical portion 10*a* of the coupling shaft 10. The coupling shaft 10 is then lifted by this pressure, the upper end of the short shaft portion 10*d* abuts upon the bottom face of the drive shaft 8, and at the same time the seat portion 10*c* comes into firm contact with the conical seat portion 45*b* of the needle valve 4 and a sealing action is obtained. As a result of this the leak passage 10*f* is closed, fuel at the injection pressure does not leak through the low pressure passage s of the needle valve 4, and the high-pressure fuel maintains its high injection pressure as it passes through the fuel passages 73 and is injected through the nozzle holes 35. This is the pilot injection state shown in FIG. 6-A and FIG. 6-B.

During this pilot injection, the fuel injection pressure acts on the pressure-receiving surface 74 at the upper end of the rotary valve 7. As a result, the rotary valve 7 is pushed down in the axial direction and the conical seat surface 72 makes surface contact with the conical surface 341 of the well enclosing wall and a frictional holding force arises. This frictional holding force is greater than a force tending to rotate the rotary valve 7 exerted by injection pressure acting at the nozzle holes 35. As a result, the rotary valve 7, having been rotated to a predetermined angle for pilot injection while the needle valve 4 was closed, is firmly held in that position during the fuel injection. Also, the contact between the conical seat surface 72 and the conical surface 341 prevents leakage of high-pressure fuel in the circumferential direction. Furthermore, the surface contact between the conical seat portion 10*c* and the conical seat portion 45*b* independently prevents unintentional rotation of the coupling shaft 10 itself.

Then, when an instruction ending the pilot injection is sent from the controller 12, the driving means 14 operates. In this preferred embodiment a current is passed through the solenoid and the armature 15 is attracted to the attracting side of the solenoid against the resistance of the urging means 16. As a result, the drive shaft 8 integral with the armature 15 is forcibly lowered in the axial direction. Because the short shaft portion 10*d* of the coupling shaft 10 is in contact with the lower end of the drive shaft 8, the coupling shaft 10 is pushed by the descending drive shaft 8 and is also forcibly lowered. When this happens, the seat portion 10*c* moves away from the conical seat portion 45*b* of the needle valve 4 and the leak passages 10*f* connects the low pressure passage s with the inside of the well 34 and a non-injection state is created.

FIG. 7-A and FIG. 7-B show the state at this time. High-pressure fuel is allowed to leak through the gap between the cylindrical portion 10*a* of the coupling shaft 10 and the first hole 45*a* and the leak passages 10*f* provided in the cylindrical portion 10*a* and the leak passages 10*f* in the short shaft portion 10*d* into the axial hole 43*a*. It then flows through the low pressure passage s between the axial hole 43*a* and the drive shaft 8 in the axial direction to the low pressure side and is discharged to outside. In this preferred embodiment it passes through the gap between the inner hole 140 of the solenoid and the drive shaft 8 and flows into the space 200 of the driving head 2 via the leak passage 150 in the underside of the armature 15 and is discharged to outside through the discharge pipe 18.

At this time, because the relationship between the injection pressure Pin and the cylinder pressure Pcyl of the combustion chamber and the atmospheric pressure Pout is Pin>Pcyl>>Pout, the high-pressure fuel is not injected through the nozzle holes 35 and a non-injection state is created.

Next, when an instruction starting a main injection is issued from the controller 12, the driving means 14 is switched to a non-operating state. In this preferred embodiment it is switched Off by the current to the solenoid being cut off. At this instant, the armature 15 and the drive shaft 8 integral therewith are lifted upward by the force of the urging means 16. As a result, the downward pushing pressure that up to then had been being applied to the coupling shaft 10 is released.

Consequently, the coupling shaft 10 receives the pressure of high-pressure fuel on the bottom face of the cylindrical portion 10*a* and ascends, and the seat portion 10*c* of the coupling shaft 10 and the conical seat portion 45*b* of the needle valve 4 are again brought into surface contact. As a result, the leak passages 10*f* are closed and the low pressure passage s is thereby cut off from the well 34 and fuel can again be injected through the nozzle holes 35.

In this state, the rotary valve 7 is rotated by the actuator 9 being driven again. This time the rotary valve 7 is rotated to an angle corresponding to a required nozzle hole area optimal for a main injection, and the degree of connection between the fuel passages 73 and the nozzle holes 35 is gradually increased. When it reaches the target angular position, the rotary valve 7 is stopped in that position and a main injection is carried out. This is the state shown in FIG. 8-A and FIG. 8-B.

After that, when an instruction ending the main injection is issued from the controller 12, the rotary valve 7 is rotated again (usually in the opposite direction) by the actuator 9 and stopped when it reaches a position corresponding to a nozzle hole area optimal for an initial injection or a position such that the nozzle hole area is zero (a position such that covering portions of the conical seat surface 72 between the fuel passages 73 face the nozzle holes 35). During the time taken to reach this state, fuel is injected. Simultaneously with this stopping of the rotary valve 7 the needle valve 4 descends and seats on the seat surface 303 and the injection ends completely.

This ends one fuel injection cycle. When the rotary valve is rotated to a position such that the nozzle hole area is zero, before the next injection is carried out the rotary valve 7 is again rotated by the actuator 9 and the degree of connection between the fuel passages 73 and the nozzle holes 35 thereby adjusted to a nozzle hole area optimal for a pilot injection.

In the control described above, to obtain accuracy of the nozzle hole area determined by the position of the rotary valve 7, the actuator 9 is driven with constant reference being made to the output of the angle detecting mechanism 11. Thus when there is an error in the position of the rotary valve 7 detected by the angle detecting mechanism 11 this can be corrected by the actuator 9 being driven accordingly and variation in the spray from injection to injection can be reduced.

Figure 9:
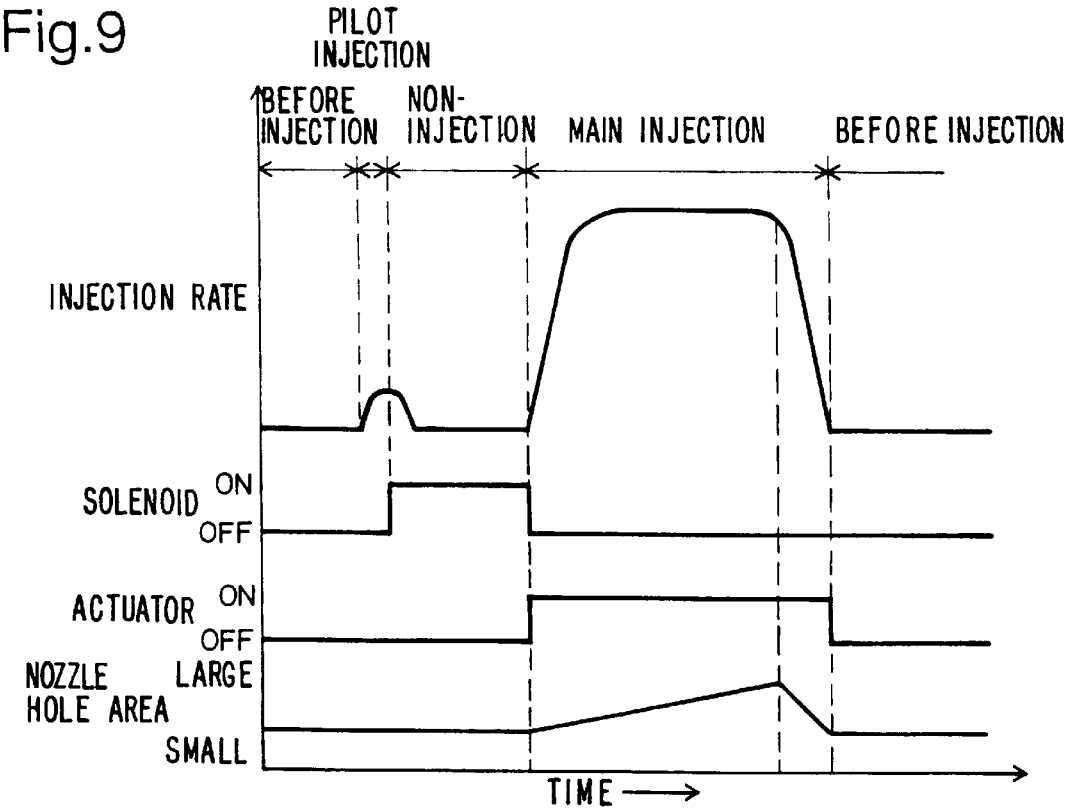
FIG. 9 is a chart showing an example of the operation of a fuel injection nozzle according to the invention.

FIG. 9 shows an example of the operation of injection control according to the invention. This example shows a case wherein before a pilot injection the rotary valve 7 is at an angle corresponding to a nozzle hole area optimal for an initial injection. However, the operation illustrated in FIG. 9 is merely an example of the invention and the invention is not limited to this and various forms can be employed according to the responsiveness of the actuator 9. For example, when an actuator having good responsiveness is used a control method may be adopted wherein before an injection the nozzle hole area is made zero and then immediately before a pilot injection the actuator is driven to rotate the rotary valve 7 to a position corresponding to a nozzle hole area optimal for the pilot injection and stop it in that position and then during a non-injection period following the pilot injection the actuator is driven to rotate the rotary valve 7 to a position corresponding to a nozzle hole area optimal for a main injection and stop it in that position.

Or, when an actuator having slower responsiveness is used, the rotary valve 7 may be rotated to a position corresponding to a nozzle hole area optimal for the main injection at the time of the pilot injection and the pilot injection may be controlled by control of a leak period using driving means 14 having fast responsiveness.

When the rotary valve shape of this preferred embodiment is adopted, because the position of the rotary valve 7 is held by fuel injection pressure only, it is possible to drive the actuator 9 and rotate the rotary valve 7 during fuel injection. Because of this, it is possible to vary the degree of connection of the nozzle holes 35 and the fuel passages 73 (the nozzle hole area) steplessly from 0% to 100% during the pilot injection and during the main injection.

Also, when the rotary valve shape of this preferred embodiment is used, because the position of the rotary valve 7 is held by fuel injection pressure only, a small and low-torque actuator can be used for the actuator 9 and it is thereby possible to avoid making the fuel injection nozzle large and facilitate disposition and mounting of the fuel injection nozzle with respect to the engine.

When the fuel passages 73 of the rotary valve 7 are constructed as channels, there is the merit that the machining of the fuel passages 73 becomes easy and cost reductions can be achieved. With this channel construction, when the channel bottoms are made parallel with the conical seat surface 72, because the area of the pressure-receiving surface 74 can be increased, the holding torque on the rotary valve 7 can be made greater.

What is claimed is:

1. A fuel injection nozzle of a type having a nozzle holder proper (1) and a nozzle body (3) and in a tip part of the nozzle body (3) a well (34) for guiding pressurized fuel and on the entrance side of this well (34) a needle valve (4) opened and closed by a predetermined fuel pressure, a plurality of nozzle holes (35) through which pressurized fuel is injected being provided spaced in the circumferential direction in a wall enclosing the well (34) and a rotary valve (7) having a plurality of fuel passages (73) corresponding to the nozzle holes (35) being disposed in the well and rotated to adjust the open area of the nozzle holes (35), wherein:

a drive arrangement of the rotary valve (7) comprises an actuator (9) mounted to the nozzle holder proper and a drive shaft (8) extending through an axial hole **(43*a*) of the needle valve (4) and having its lower end reaching the vicinity of the lower end of the needle valve (4) and a coupling shaft (10) positioned inside a control hole (45) provided in the lower end of the needle valve (4), the coupling shaft (10) being connected to the drive shaft (8) and to the rotary valve (7)** movably in the axial direction relative to each;

a low pressure passage (s) for guiding leak fuel in the axial direction is formed between the drive shaft (8) and the axial hole **(43*a*) and between the coupling shaft (10) and the control hole (45) a leak passage (10*f*) for connecting the low pressure passage (s) with the inside of the well is provided and the coupling shaft (10) and the control hole (45) respectively comprise seat portions (10*c*), (45*b*) and these seat portions (10*c*), (45*b*) make contact with each other and prevent opening of the leak passage (10*f*) when the coupling shaft (10) is lifted by a pressure of pressurized fuel along with opening of the needle valve (4); and on the nozzle holder proper side there are provided driving means (14) for forcibly moving the coupling shaft (10) in the axial direction while the needle valve (4) is open to move the seat portions (10*c*), (45*b*) apart to open the leak passage (10*f*)**.

2. A fuel injection nozzle according to claim 1, further comprising urging means (16) for bringing the seat portions **(10*c*), (45*b*) into contact again when the driving means (14)** stops operating.

3. A fuel injection nozzle according to claim 2, wherein the driving means (14) has a solenoid and an armature (15) fixed to the drive shaft (8) and by the drive shaft (8) being moved in the axial direction by the armature (15) being attracted to the solenoid the coupling shaft (10) is moved in the axial direction and the urging means (16) comprises an elastic member for urging the armature (15).

4. A fuel injection nozzle according to claim 1, wherein the control hole (45) has a first hole **(45*a*) opening at the lower end of the needle valve (4) and a second hole (45*c*) connecting with the axial hole (43*a*) of the needle valve (4) and a conical seat portion (45*b*) is provided between the first hole (45*a*) and the second hole (45*c*) and the coupling shaft (10) has a cylindrical portion (10*a*) fitting in the first hole (45*a*) and at the upper end of this cylindrical portion (10*a*) a conical seat portion (10*c*) corresponding to the conical seat portion (45*b*) and at the upper end of the seat portion (10*c*) a short shaft portion (10*d*) passing through the second hole (45*c*) and the leak passage (10*f*) is formed in this short shaft portion (10*d*)**.

5. A fuel injection nozzle according to claim 1, wherein the control hole (45) has a first hole **(45*a*) opening at the lower end of the needle valve (4) and a second hole (45*c*) connecting with the axial hole (43*a*) of the needle valve (4) and a conical seat portion (45*b*) is provided between the first hole (45*a*) and the second hole (45*c*) and the coupling shaft (10) has a cylindrical portion (10*a*) fitting in the first hole (45*a*) and at the upper end of this cylindrical portion (10*a*) a conical seat portion (10*c*) corresponding to the conical seat portion (45*b*) and at the upper end of the seat portion (10*c*) a short shaft portion (10*d*) passing through the second hole (45*c*) and a leak passage (10*f*) is formed in each of this short shaft portion (10*d*) and the cylindrical portion (10*a*)** respectively.

6. A fuel injection nozzle according to claim 4, wherein the leak passage **(10*f*) of the short shaft portion (10*d*)** is a vertical channel formed in the outer circumferential surface of the short shaft portion.

7. A fuel injection nozzle according to claim 5, wherein the leak passages **(10*f*) of the short shaft portion (10*d*) and the cylindrical portion (10*a*) are vertical channels formed in the outer circumferential surfaces of the short shaft portion (10*d*) and the cylindrical portion (10*a*) and the vertical channel of the cylindrical portion (10*a*) reaches the seat portion (10*c*)**.

8. A fuel injection nozzle according to claim 1, wherein the coupling shaft (10) has a groove **(10*b*) in its bottom face and a projecting piece (70) formed on the rotary valve (7) is fitted in this groove (10***b*) axially slidably with respect thereto and a groove (80) is provided in the lower end of the drive shaft (8) and a projecting piece (10*e*) provided on the upper end of the coupling shaft (10) is fitted in this groove (80) axially slidably with respect thereto.

9. A fuel injection nozzle according to claim 1, wherein the enclosing wall of the well has a conical surface (341) and the nozzle holes (35) open at this conical surface (341) and the rotary valve (7) has at its upper end a pressure-receiving surface (74) for receiving pressure of pressurized fuel and has at its circumferential periphery a conical seat surface (72) corresponding to the conical surface (341) and the conical surface (341) and the conical seat surface (72) make contact when an injection pressure acts on the pressure-receiving surface (74).

10. A fuel injection nozzle according to claim 1, further comprising an angle detecting mechanism mounted on the output side of the actuator (9) for detecting the angle of the rotary valve, wherein driving of the actuator is controlled on the basis of a signal from this angle detecting mechanism.

11. A fuel injection nozzle of a type having a nozzle holder proper (1) and a nozzle body (3) and in a tip part of the nozzle body (3) a well (34) for guiding pressurized fuel and on the entrance side of this well (34) a needle valve (4) opened and closed by a predetermined fuel pressure, a plurality of nozzle holes (35) through which pressurized fuel is injected being provided spaced in the circumferential direction in a wall enclosing the well (34) and a rotary valve (7) having a plurality of fuel passages (73) corresponding to the nozzle holes (35) being disposed in the well and rotated to adjust the open area of the nozzle holes (35), wherein:

the enclosing wall of the well has a conical surface (341) and the nozzle holes (35) open at this conical surface (341) and the rotary valve (7) has at its upper end a pressure-receiving surface (74) for receiving pressure of pressurized fuel and has at its circumferential periphery a conical seat surface (72) corresponding to the conical surface (341);

a drive arrangement of the rotary valve (7) comprises an actuator (9) mounted to the nozzle holder proper and a drive shaft (8) extending through an axial hole (43*a*) of the needle valve (4) and having its lower end reaching the vicinity of the lower end of the needle valve (4) and a coupling shaft (10) positioned inside a control hole (45) provided in the lower end of the needle valve (4), the coupling shaft (10) being connected to the drive shaft (8) and to the rotary valve (7) movably in the axial direction relative to each;

a low pressure passage (s) for guiding leak fuel in the axial direction is formed between the drive shaft (8) and the axial hole (43*a*) and between the coupling shaft (10) and the control hole (45) a leak passage (10*f*) for connecting the low pressure passage (s) with the inside of the well is provided and the coupling shaft (10) and the control hole (45) respectively comprise seat portions (10*c*), (45*b*) and these seat portions (10*c*), (45*b*) make contact with each other and prevent opening of the leak passage (10*f*) when the coupling shaft (10) is lifted by a pressure of pressurized fuel along with opening of the needle valve (4); and on the nozzle holder proper side there are provided driving means (14) for forcibly moving the coupling shaft (10) in the axial direction while the needle valve (4) is open to move the seat portions (10*c*), (45*b*) apart to open the leak passage (10*f*).

* * * * *